US006607418B2

(12) United States Patent
Henry

(10) Patent No.: US 6,607,418 B2
(45) Date of Patent: Aug. 19, 2003

(54) DISCOVERY TOY AND METHOD OF USE

(75) Inventor: Brian Henry, Fort Payne, AL (US)

(73) Assignee: Playcore Wisconsin, Inc., Janesville, WI (US)

( * ) Notice: Subject to any disclaimer, the term of this patent is extended or adjusted under 35 U.S.C. 154(b) by 0 days.

(21) Appl. No.: 09/899,403

(22) Filed: Jul. 5, 2001

(65) Prior Publication Data

US 2002/0094745 A1 Jul. 18, 2002

Related U.S. Application Data

(60) Provisional application No. 60/246,440, filed on Nov. 7, 2000.

(51) Int. Cl.[7] ..... A63H 33/32

(52) U.S. Cl. ..... 446/70; 446/166; 446/482; 434/126

(58) Field of Search ..... 446/70, 478, 479, 446/482, 166, 168, 173; 47/64; 108/24, 25, 60; 472/126; 434/126, 151

(56) References Cited

U.S. PATENT DOCUMENTS

| | | | | |
|---|---|---|---|---|
| 1,018,373 A | * | 2/1912 | Robbins | |
| 4,056,892 A | * | 11/1977 | Atencio | 35/10 |
| 4,057,244 A | * | 11/1977 | Gaspar | 272/1 A |
| 5,509,844 A | * | 4/1996 | Poirier et al. | 446/71 |
| 5,556,181 A | * | 9/1996 | Bertrand | 312/313 |
| 5,971,764 A | * | 10/1999 | Todd | 434/126 |
| 6,058,851 A | * | 5/2000 | Alexander et al. | 108/25 |

* cited by examiner

*Primary Examiner*—Derris H. Banks
*Assistant Examiner*—Jamila Williams
(74) *Attorney, Agent, or Firm*—Welsh & Katz, Ltd.

(57) ABSTRACT

A discovery toy/play feature apparatus, for use with water and sand, or other particulate or granular material is provided. The apparatus allows the user to play in both sand and water in such a way as to learn and discover physical and engineering principles while having fun. The play feature apparatus allows the user to bury objects in the sand and play as if the user was on a beach looking for shells or to play as if the user was an archeologist. Further the user is allowed to use the varying channels and pools to make dams and other water obstructions and learn fluid mechanics and engineering principles while having fun.

11 Claims, 5 Drawing Sheets

DISCOVERY TOY AND METHOD OF USE

This application claims the benefit of Provisional application Ser. No. 60/246,440, filed Nov. 7, 2000.

FIELD OF THE INVENTION

The present invention concerns a novel play and discovery toy that offers children the opportunity to manipulate sand, or other granulated or particulate substances, and water in one play experience. The present invention is generally directed towards use by young children.

BACKGROUND OF THE INVENTION

Playground and backyard play equipment have traditionally included such play devices as swing-sets, tree houses, lawn games, and sand boxes on which children may entertain themselves. These devices, while entertaining, are generally made for fun alone and do not allow a child to stretch the imagination or discover scientific or physical principals.

Sand boxes found in most playgrounds and backyards, generally comprise a frame having a bottom, generally water impermeable (to keep sand from escaping and insect and other wild life from entering the box), and playground, or fine grade, sand. Children using such sand boxes are generally required to bring extra toys to the sand box with which to play. Typically, the extra toys include shovels and pails, for building sand castles, trucks and or dolls. In such situations, the sand becomes a medium for play with other toys, rather than a source of fun and discovery.

In many instances, as play progresses a child may, using a pail or hose, bring a quantity of water to the sand box. Such water is often used to create a moat for a castle created within the sand box or is used to moisten the sand and thus improve its adhesive qualities so that sand structures may be built. Often times, however, the bringing of extraneous water to the sand box serves to create a messy situation that quickly causes the sand box to become unusable. Further, users of a sand box in which water has been introduced, oftentimes become coated in sand, as the sand's adhesive power has been increased causing discomfort or anxiety (especially in younger children). It is customary, in the use of sandboxes, for the participants to immerse themselves within the boundaries of the sandbox. As such, the user is often covered and coated in sand and tends to carry a portion of the sand from the environs, causing a mess wherever the sand is next deposited and a net loss of sand for the sandbox.

The present invention involves a discovery toy that encompasses a sand and water table apparatus and a method of using the apparatus that allows children to play with both sand and water while remaining clean and dry. While the term "sand" is used herein, and throughout the following specification, it will be understood by persons having skill in the art that any granulated or particulate material having characteristics similar to those of sand may be used without departing from the novel scope of the present invention. Further, it will be understood by persons having skill in the art that other substances having properties which generally allow for the simulation of construction, excavation, modeling and sculpturing, may be substituted without departing from the novel scope of the present invention. Also, while the term "water" is used herein, and throughout the specification, it will be understood that any liquid, having the desired properties expressed herein, can be substituted without departing from the novel scope of the present invention.

The present invention allows children to play in an environment that permits play with sand in a discovery and learning situation. Further, children may learn archeological and engineering principals that may fascinate them, at this early age, and lead them to a rewarding career.

Other objects and advantages of the present invention will become apparent as the description proceeds.

SUMMARY OF THE INVENTION

In accordance with the present invention a discovery toy is provided, comprising a table, divided into at least one first area for holding a liquid and at least one second area for holding a quantity of a particulate or a granulated matter. The table is designed such that some of the liquid can be placed in the first area and a quantity of particulate or granulated matter can be placed in the second area such that a user can play with both a liquid and particulate or granulated matter on the same table without having to mix the substances. In a preferred embodiment of the present invention, the table is elevated, with legs, to a comfortable play level. Further, any of the embodiments of the present invention may be covered by a canopy or other desirable cover which will allow play to continue beneath the cover and provided protection from the elements.

In a preferred embodiment of the discovery toy the particulate or granulated matter is sand, such as the sand typically found in children's sandboxes. Further, in a preferred embodiment of the present invention the liquid used is water.

In one embodiment of the discovery toy of the present invention, the first area is elongated and channel shaped, such that water can flow from near one end of the table to another end. Further, in an embodiment having a channel shaped first area, there can be included at least two sand holding areas, such that the sand areas surround the water channel. In this way an interesting river or canal scenario is developed.

In another preferred embodiment, a second table is included and is attached adjacent the first table such that water on the first table may flow to the second table. In one such embodiment, the first table can be elevated on legs and the second table can be placed below and extending from the first table. In such an embodiment, the first table can define an opening in at least one of the liquid holding areas such that liquid may flow off of said first table and onto the second table. It will be understood that other embodiments, having more than two tables, may be made without departing from the novel scope of the present invention.

The present invention, further, includes a method of using the discovery toy. The method includes the steps of providing at least one table, divided into at least one first area for holding a liquid and at least one second area for holding a quantity of a particulate or a granulated matter. Placing some quantity of liquid in the first area and placing a quantity of particulate or granulated matter in the second area and playing with liquid and particulate or granulated matter on the table. The method further includes providing a second table adjacent to and at a lower level than the first table and providing an opening on the first table such that the liquid may flow from the first table to the second table. In one embodiment of the method of use of the present invention, objects that can be used to play in the sand and water areas of the discovery toy, are removably placed in the body, and specifically the top surface, of the discovery toy. Such play objects may the be easily taken from a storage space on the discovery toy, used for play or discovery, and replaced for storage on the discovery toy subsequent to use.

In the use of the discovery toy of the present invention at least one play table, having support means, is elevated to a desirable height. The play table includes sections, formed as large areas, channels, and pools for the placement, alternatively, of sand and water, such that play and discovery situations may be created. The large areas may be filled with sand and the channels and pools may be filled with water.

In the sand areas, fossils, seashells and sand dollars, as well as other items, may be placed to allow the user a play opportunity. The user may imaging that he is on a beach, digging for shells, or that she is on an archeological dig, searching for dinosaur remains, or that he is an engineer constructing a building or water project. In the water areas, a large water pool may be used to feed water to other areas of the play table via a series of varying channels and pools. The user may learn about aspects of water by using dams and other water diversions to manipulate the flow and direction of the water.

In one embodiment, a series of play tables, having necessary means to elevate the tables to different heights progressively in series, are included and water is permitted to cascade, in a realistic looking waterfall, from one table to the next.

In another embodiment, innovative accessories are included to enhance the play on the table or tables. Such accessories may include a sand stamp cup, comprising a plurality of different sand stamp imprints, such as animal paw prints, numbers, letters, and shapes. Such cups may also be used to manipulate volumes of sand and water pools and water falls. Another accessory is a roof which may be attached to the table to provide shade for the users. Further, the roof allows the users of the table to create other imaginary play opportunities, including situations in space, or in the dark (such as a night) and others.

A more detailed explanation of the invention is provided in the following description and claims and is illustrated in the accompanying drawings.

DETAILED DESCRIPTION OF THE ILLUSTRATIVE EMBODIMENT

Figure 1:
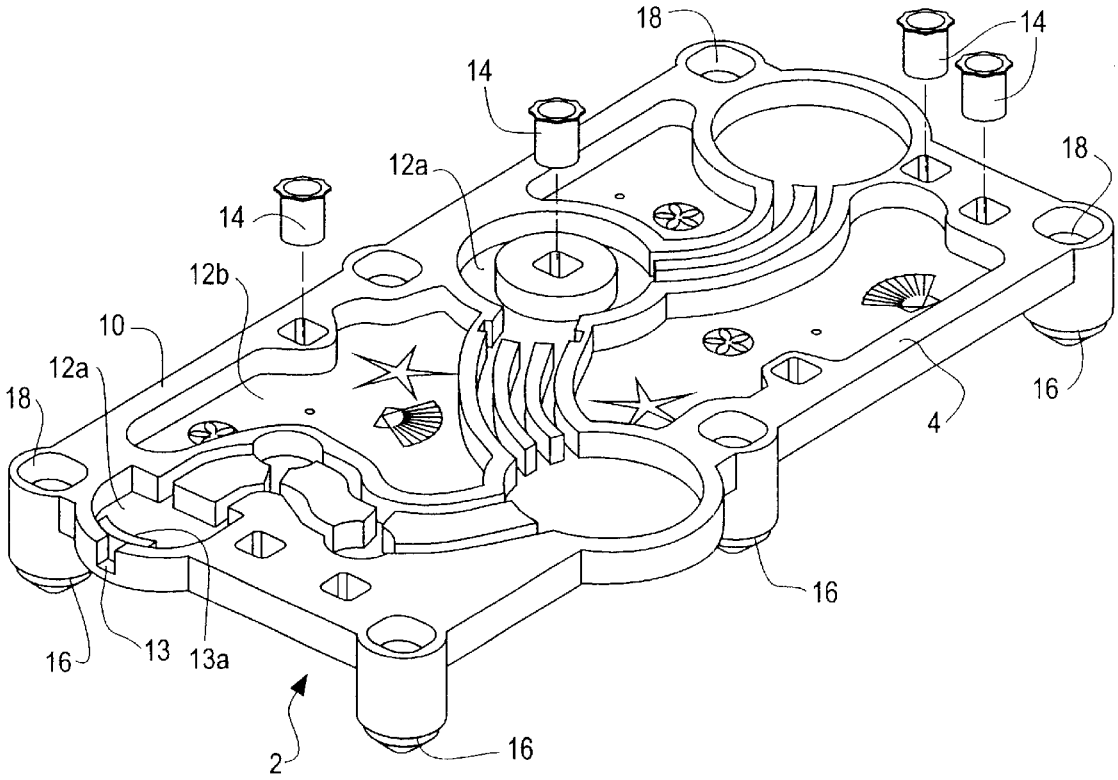
FIG. 1 is a perspective view of the play apparatus of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Figure 3:
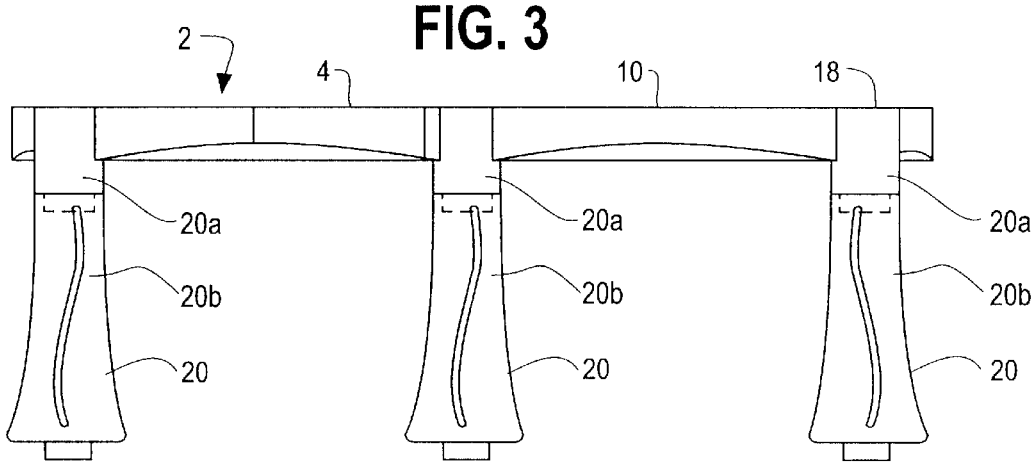
FIG. 3 is a side elevational view of the play apparatus of the present invention.

Referring to the drawings, a discovery toy 2, comprising at least one sand and water table 4. Each sand and water table 4 of a discovery toy of a preferred embodiment of the present invention, comprises a table top 10 having water areas 12*a* and sand areas 12*b*, at least one sand cup 14, leg openings 16 and table support openings 18. Discovery toy 2 further comprises legs 20, shown in FIG. 3. Legs 20 are provided to support table 4 at a desired level.

In a preferred embodiment, discovery toy 2 is made of a resilient plastic material which has been molded into the desired form. Water areas 12*a* sand areas 12*b* are produced in the molding process. An opening 13, which will be described in greater detail below, may also be made during a molding process. Legs 20 and sand cups 14 may be similarly produced, using separate molding procedures. It will be understood, however, that the manufacture of a discovery toy 2 of the present invention, and the various parts associated therewith, may be accomplished by any number of manufacturing processes well known in the art.

In one embodiment of the device of the present invention, legs 20 are made such that a base leg portion 20*a*, which extends below the underside of the table, may be attached to an extension leg portion 20*b* to provide a desired, and changeable, height for the table top 10. It will be seen that extension leg portion 20*b* may be removed to provide a table top 10 closer to a ground surface. Further, as will be explained in greater detail below, extension leg portion 20*b* may be removed and sand and water table 4 may be attached to a second sand and water table 4*a* by the placement of the base leg portion 20*a* of table 4 onto the top surface 10, in a table support opening 18, of table 4*a*. It will be understood, and explained in greater detail below, that various heights of leg portions 20*a* and extension leg portions 20*b* may be used to arrive at desired table levels and combinations of tables.

It is to be understood that the term sand, as used in the present invention, includes that substance typically found in sand boxes and children's play areas, and includes all granulated and particulate matter that is typically or may be substituted therefore. It is to be further understood, that the term water, as used herein, is meant to encompass any liquid or fluid which is typically or maybe used in such play areas.

The discovery toy 2 of the present invention may include other accouterments typically found in play toys, such as a cover or protective top (FIG. 10), and other play, safety or educational features, without departing from the novel scope of the present invention.

Figure 2:
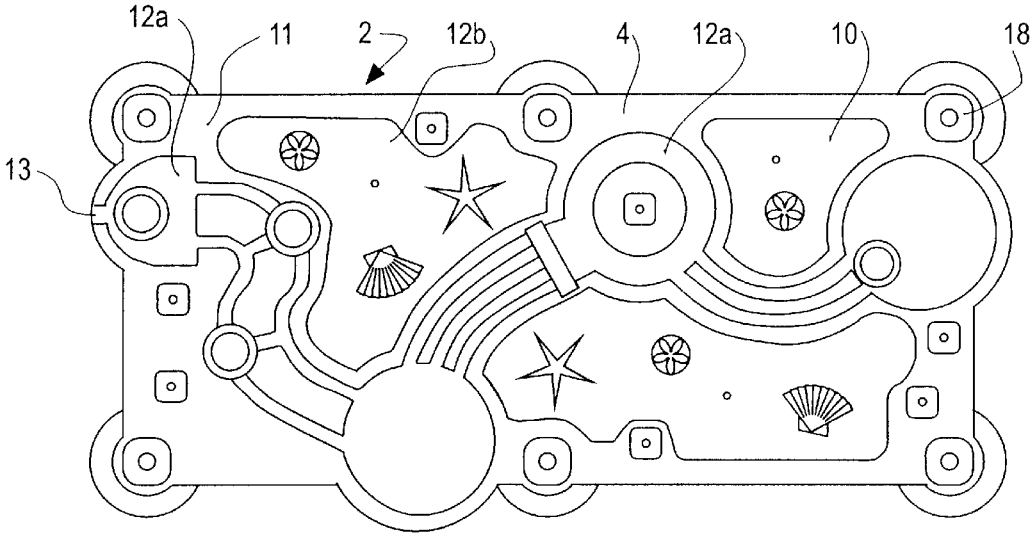
FIG. 2 is a top plan view of the play apparatus of the present invention.

It may be seen, in FIG. 2, that table top 10, of a preferred embodiment, may include a wide variety and number of water areas 12*a* and sand areas 12*b*. It is to be understood that any variation in the number, type, placement, size, depth and other dimensions of the water 12*a* and sand areas 12*b* may be made in discovery toy 2, by persons having skill in the art, without departing from the novel scope of the present invention. It will also be understood, that depending on the type of activity being pursued on discovery toy 2, sand areas may be used as water areas, and vice-versa, without departing from the novel scope of the present invention. It will also be understood that any one or more sand areas maybe used as one or more water areas, leaving the other sand areas as sand areas, and vice-versa, without departing from the novel scope of the present invention.

Figure 4:
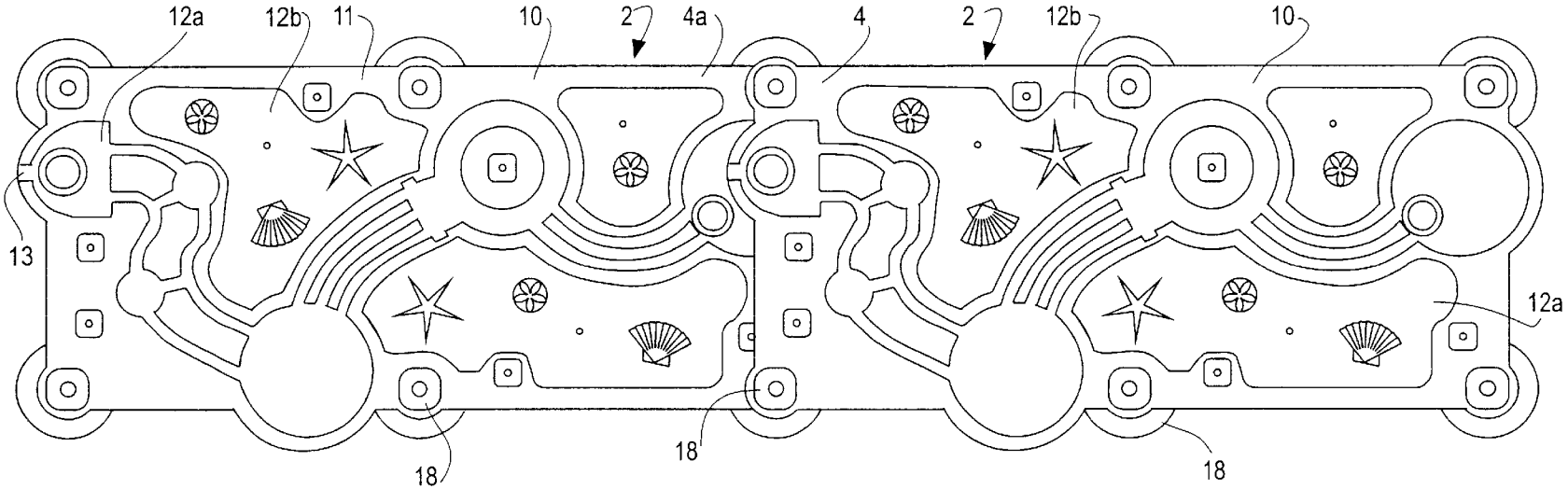
FIG. 4 is a top plan view of an assembly of two of the apparatuses of the present invention, connected in sequence.
Figure 10:
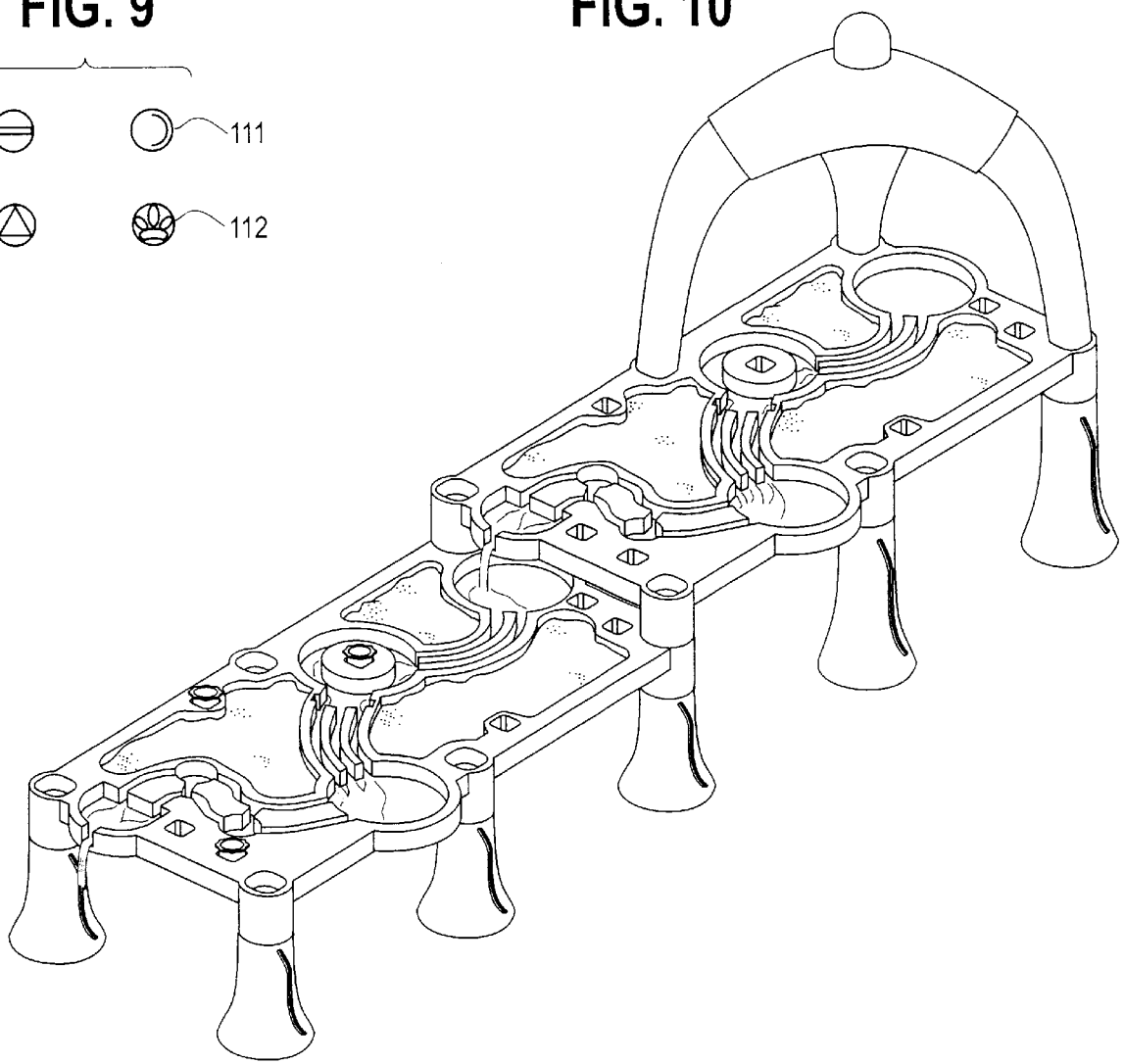
FIG. 10 is a perspective view of two play apparatuses of the present invention used in cooperation with each other.

FIG. 4 and FIG. 10 show other embodiments of a discovery toy 2, made by the combination of two sand and water tables 4 of the present invention. Further, to aid in the combination of two or more tables 4, an opening 13, in a water area 12*b*, can be made at the edge 11 of table 10, such that water, on table 4 may flow off of table 4 and onto a second table 4*a*, below. Such an opening allows the operative connection of water areas 12*a* of one table 4 with another table 4*a*. As shown in many of the figures, opening 13, of a preferred embodiment, is made as an integral part of table 4. It will be understood that, typically, when use of an opening 13 is not desired, some form of blockage, such as blocking piece 13*a* (FIG. 1) can be placed within a water area 12*a* so as to inhibit the flow of liquid from table 4.

Figure 5:
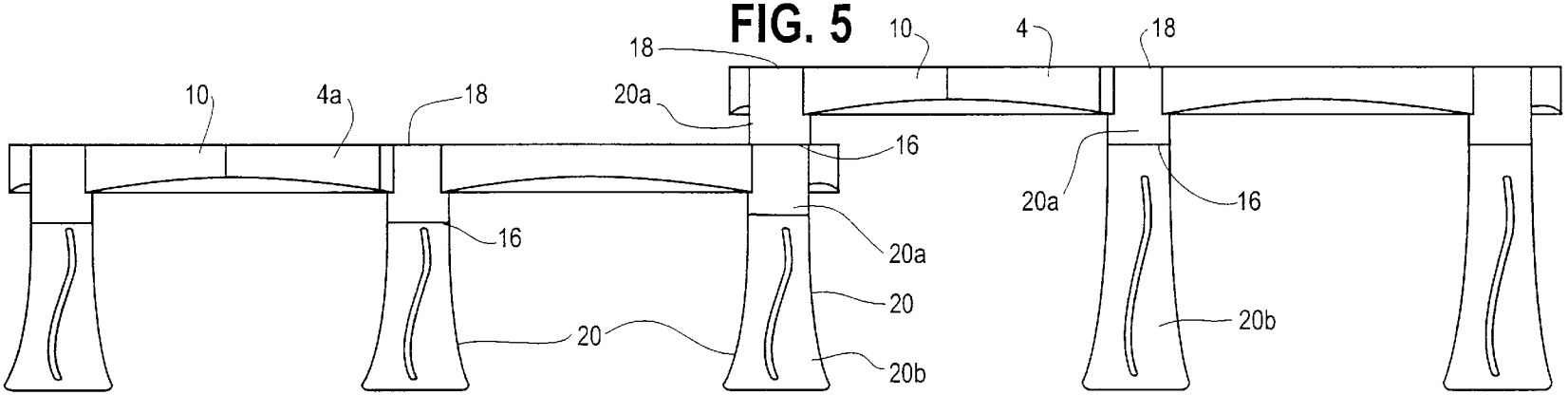
FIG. 5 is a side elevational view of the play assembly shown in FIG. 4.
Figure 6:
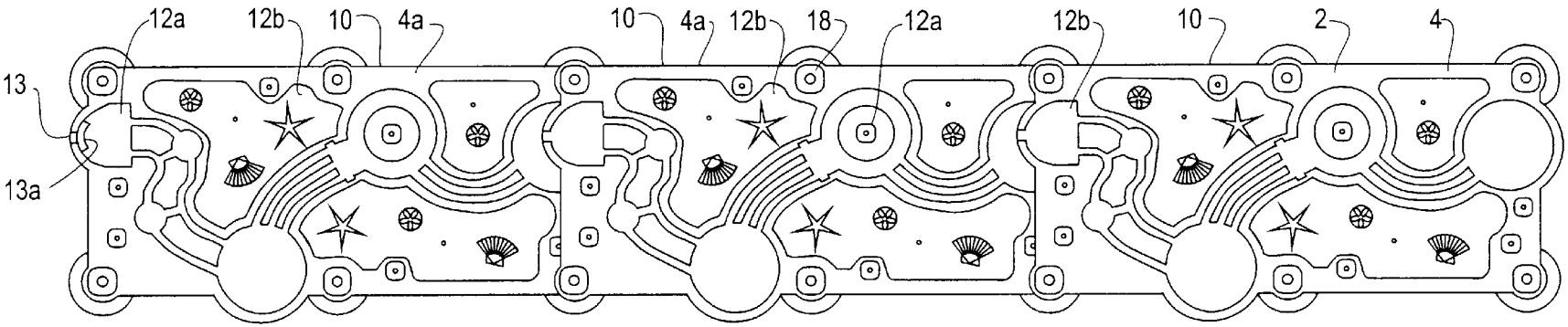
FIG. 6 is a top plan view of an assembly of three apparatuses of the present invention, connected in sequence.
Figure 7:
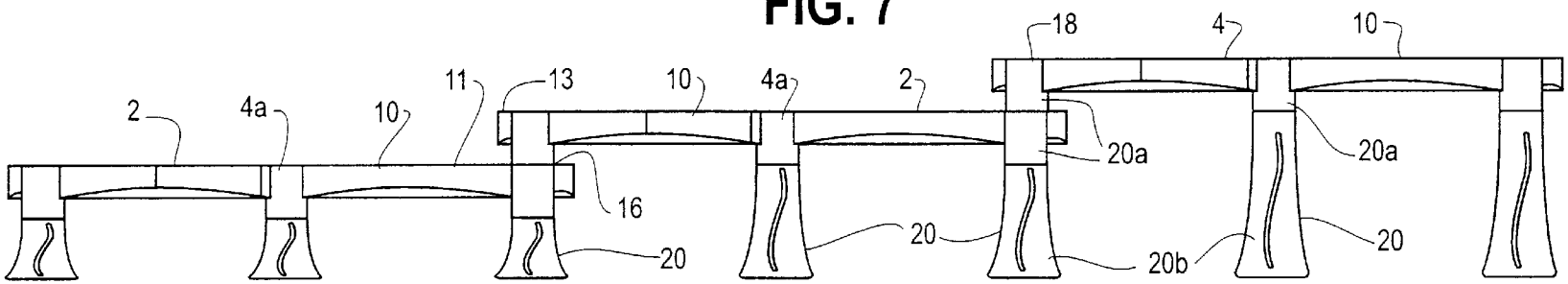
FIG. 7 is a side view of the play apparatus shown in FIG. 6.

FIG. 6 shows a discovery toy 2 comprised of the combination of three sand and water tables 4 of the present invention. It is to be understood that any number of sand and water tables 4 of the present invention may be combined without departing from the novel scope of the present invention. As shown in FIGS. 5 and 6, the combination of the tables 4 is accomplished using legs 20 of different heights. In this manner the sequence of tables 4 generally rises as tables are added, allowing water to flow from the higher table 4 to the lower tables 4*a*. Overlap of one table 4 with the other is accomplished by placing the leg opening 16 of the taller table 4 into the support opening 18 of the lower table 4*a*. As the leg openings 16 are located below the table, the placement of one table 4*a* in this manner on a preceding table 4 provides an overlap such that flowing water will fall onto the surface 11 of the table top 4*a*. It can be seen that three tables 2 may be connected in the manner shown in FIGS. 6 and 7. It is to be understood that three tables may be connected such that the each of the tables 4 at the ends are elevated above the table interconnecting them, such that the end tables 4 both allow water to pour onto the center table 4, without departing from the novel scope of the present invention. Further, it will be understood that a center table maybe elevated onto two lower end-tables. Other combinations, including tables placed at angles to each other, are also possible and envisioned as being within the scope of the present invention.

Figure 9:
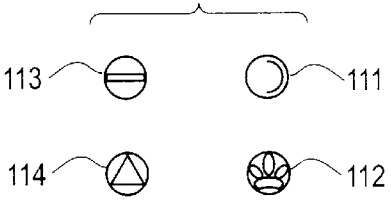
FIG. 9 is a plan view of alternative tops for the stamp cup of FIG. 8.
Figure 8:
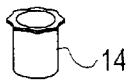
FIG. 8 shows a perspective view of a sand stamp cup of the present invention.

FIG. 8 shows a perspective view of a sand stamp cup 14. The cup 14 may be used to stamp images into sand, or other particulate matter, may be used to make cylinders of compressed sand (such as those used in the creation of sand castles) or can be used to move water from one area of table 4 to another. As shown in FIG. 9, stamp cup 14 may include design elements on the closed side of the cup. The design elements of stamp cup 14 may take the form of a semi-circle or "C"111, an animal paw print 112, a triangle 113 (or other simple shape) and 114 a line segment. It is to be understood that the design elements shown are merely made for illustration and that a plethora of shapes and other design elements may be used on cup 14 without departing from the novel scope of the present invention. A cup 14, of the present invention, may also be used to lift sand and/or water from one area of a table 4 to another area or from one table 4 to another table. It is to be understood that cups having varying shapes and sizes may be used without departing from the novel scope of the present invention.

Although an illustrative embodiment of the invention has been shown and described, it is to be understood that various modifications and substitutions may be made by those skilled in the art without departing from the novel spirit and scope of the invention.

What is claimed:

1. A discovery toy comprising:

a table, having a generally horizontal play surface, said play surface divided into at least one first area for holding a liquid, said first area being elongated and channel shaped, and at least two second areas for holding a quantity of a particulate or a granulated matter, said first area being completely separated from and dividing said two second areas, such that some quantity of liquid can be placed in said at least one first area and a quantity of particulate or granulated matter can be placed in either one or both of said two second areas such that a user can play with both a liquid and a particulate or granulated matter on said table.

2. A discovery toy comprising:

a first table, divided into at least one first area for holding a liquid and at least one second area for holding a quantity of a particulate or a granulated matter, such that some quantity of liquid can be placed in said at least one first area and a quantity of particulate or granulated matter can be placed in said one second area such that a user can play with both a liquid and a particulate or granulated matter on said table; and a second table attached to said first table such that water on said first table may flow to said second table.

3. A discovery toy comprising:

A first table and a second table, each of said first table and said second table being divided into at least one first area for holding a liquid and at least one second area for holding a quantity of a particulate or a granulated matter, such that some quantity of liquid can be placed in said at least one first area and a quantity of particulate or granulated matter can be placed in said one second area such that a user can play with both a liquid and a particulate or granulated matter on said first table and said second table;

said first table defining an opening in at least one of said first areas for holding liquids such that liquid may flow off of said first table;

said first table being placed adjacent to and at a higher level than said second table such that liquid flowing off of said first table flows to a first area for holding liquids on said second table.

4. The discovery toy of claim 3, including at least one of a particulate matter and a granulated matter, wherein said at least one of said particulate and granulated matter is sand.

5. The discovery toy of claim 3, including a liquid, wherein said liquid is water.

6. The discovery toy of claim 3, wherein at least one of said first areas is elongated and channel shaped.

7. The discovery toy of claim 6, including at least two second areas on at least one of said tables, said at least one first area dividing said two second areas.

8. The discovery toy of claim 3, including at least one more table attached to the discovery toy such that water on said first table may flow to said one more table.

9. A method of using a discovery toy, including the steps of:

providing at least one table, said table comprising a first table, being divided into at least one first area for holding a liquid and at least one second area for holding a quantity of a particulate or a granulated matter;

placing a quantity of liquid in said at least one first area;

placing a quantity of particulate or granulated matter in said at least one second area;

playing with said liquid and said particulate or granulated matter on said table; and providing a second table adjacent to and at a lower level than said first table and providing an opening on said first table such that liquid may flow from said first table to said second table.

10. The method of claim 9, including providing a series of second tables, each of said second tables being adjacent to and below another of said second tables.

11. The method of claim 9 including one or more tables adjacent to said first table such that liquid may flow from said first table to any adjacent table.

* * * * *